United States Patent [19]

McJunkin, Jr.

[11] Patent Number: 4,913,402

[45] Date of Patent: Apr. 3, 1990

[54] AUTOMOTIVE FLOOR JACK

[76] Inventor: Howard P. McJunkin, Jr., 862 Alta Rd., Charleston, W. Va. 25314

[21] Appl. No.: 309,378

[22] Filed: Feb. 13, 1989

[51] Int. Cl.[4] ..... B66F 3/24

[52] U.S. Cl. ..... 254/93 R; 254/89 H; 254/93 H

[58] Field of Search ..... 254/89 H, 93 R, 93 VA, 254/93 L, 93 H, 93 A, 122, 423, DIG. 1; 405/3, 4, 7

[56] References Cited

U.S. PATENT DOCUMENTS

| | | | |
|---|---|---|---|
| 1,961,501 | 6/1934 | Liebler | 254/93 |
| 2,024,291 | 12/1935 | Jackson | 254/93 |
| 2,070,960 | 2/1937 | Phillips | 254/93 |
| 2,115,328 | 4/1938 | Cola | 254/86 |
| 2,163,959 | 6/1939 | Nilson | 254/89 |
| 2,380,152 | 7/1945 | David | 254/93 |
| 2,381,664 | 8/1945 | Hansen | 22/48 |
| 2,429,014 | 10/1947 | Christopher | 254/93 |
| 2,562,493 | 7/1951 | Harris | 254/93 |
| 2,891,765 | 6/1959 | Pearne | 254/2 |
| 2,984,072 | 5/1961 | Born | 60/97 |
| 3,288,436 | 11/1966 | Silva | 254/86 |
| 3,608,863 | 9/1971 | Gaardner | 254/93 HP |
| 4,690,250 | 9/1987 | Bergstrom | 254/122 |

FOREIGN PATENT DOCUMENTS

| | | | |
|---|---|---|---|
| 356363 | 9/1961 | Switzerland | 254/93 R |

*Primary Examiner*—Judy Hartman

*Attorney, Agent, or Firm*—Cushman, Darby Cushman

[57] ABSTRACT

A portable automotive jack is provided having a generally triangular configuration defined by first and second pairs of pneumatic cylinders. Specifically, the cylinders of one of the pairs of are spaced apart from one another and straddle the cylinders of the other pair so that the pairs of cylinders define the legs of a triangle. A lift plate is mounted to the upper ends of the hydraulic cylinders at the apex of the triangle whereby actuation of the cylinders moves the lift plate relative to the base member to permit jacking of a vehicle therewith. The jacking assembly, by virtue of a common source of air pressure and flexible mounts, adjusts in angle and position to accommodate changes in angle of the vehicle as it is bieng jacked thus providing a device which has an inherent stability and relative insensitivity to the hardness and flatness of the jacking surface and the construction of modern cars.

6 Claims, 5 Drawing Sheets

AUTOMOTIVE FLOOR JACK

BACKGROUND OF THE INVENTION

1. Field of the Invention

The present invention relates to lifting or jacking mechanisms and, in particular, to a portable automotive floor jack which has inherent stability, relative insensitivity to the hardness and flatness of the jacking surface, sensitivity to the construction of modern cars, and provides a "fail safe" structure should a jacked vehicle move forward or backward while on the jack.

2. Description of the Related Art

A variety of automotive floor jacks and in particular portable floor jacks have been developed over the years in an effort to provide reliable jacking structures which minimize the strength required to jack the vehicle and are simple to operate so that use of the jack requires a minimum of skill. For example, screw jacks, screw/scissors, free standing telescoping hydraulic cylinders and a variety of hydraulic cylinder actuated lever jacks have been developed, some of which have become relatively popular. However, all of the jacking mechanisms must be supplemented with jack stands, if one is to work safely under the car, and none of the structures can be considered to be safe because of the likelihood of misuse and/or the inherent instability of the structure. In addition, many of the jacking mechanisms developed in the past were designed to lift on heavy structural members such as solid axle differential housings, ladder type frames and stout cross members. For example, the most versatile and popular jack-type, the hydraulic lever jack, is designed to lift on such structural members. However, few modern cars posses any of these characteristics and indeed few cars are now made with a frame.

Another common feature of the popular hydraulic lever jack is the use of a long handle in order to get leverage to operate the hydraulic pump. However, this makes it very difficult to use the jack in close quarters. Further, because the actuated lever translates about a pivot in the jack frame, the frame must have wheels on it to allow the frame to move to compensate for necessary translation. These four wheels must roll on a hard, smooth, flat surface if the jack is to operate properly and safely. Any other surface can create hazards since the wheels form the jack's base and the stability of the base depends on unimpeded movement on a uniformly hard and flat surface which is preferably smooth finished concrete.

It would be therefore be desirable to provide an automotive floor jack which has inherent stability, relative insensitivity to the hardness and flatness of the jacking surface by virtue of permitting the base and the lift pad to conform and adapt to less than ideal surfaces to jack between.

It would further be desirable to provide a jack structure which adjusts in angle and position to accommodate changes in angle of the vehicle as it is being jacked.

SUMMARY OF THE INVENTION

These and other objects are realized in accordance with the present invention by adopting the inherent stability of the geometry of a tetrahedron thereby minimizing the number and size of structural members defining the jack. Thus, the jack provided in accordance with the present invention includes two pairs of, for example, air actuated cylinders such as automotive air shocks which are arranged to oppose each other, one pair being widely spaced and the other pair being closely spaced and straddled by the widely spaced cylinders, all operating on axes parallel to the center line of the base to which their lower mounts attach. The upper mounts of the air cylinders are attached to a lifting pad assembly. Further, the widely spaced pair of air cylinders are joined by a plate that triangulates and stabilizes the two cylinders but otherwise does not interfere with actuation of the jack mechanism. This plate reduces degrees of freedom yet permits accommodation to the change in geometry of the vehicle as it is being lifted.

While the use of the jack of the present invention by one of ordinary skill is similar to using a conventional automotive jack, less concern is needed to position the jack of the invention to assure that no damage is done to vulnerable unibody areas that are not typically good jacking surfaces or points and can be easily dented or otherwise damaged by state of the art jacks. Similarly, the condition of the floor or surface upon which the jack is set need not be as much of a concern.

Further, if air cylinders are employed rather than hydraulic cylinders, the jack of the invention does not need a long pump handle typically required with conventional hydraulic jacks, permitting use of the invention in close quarters.

Additionally, the automotive jack of the invention specifically described herein as well as any number of variations thereof embodied in the present invention possess a more stable geometry and otherwise a more safe configuration than similarly sized conventional jacks, notwithstanding the fact that reasonable judgment and recommended practice suggests the use of redundant support means, particularly if one is to work under a jacked vehicle, no matter what kind of jack is used.

In summary, when employed as an automotive jack, the present invention should provide one of ordinary skill a more versatile, easily used and safer jacking mechanism, better adapted to contemporary vehicle design than state of the art jacks.

Other objects, features and characteristics of the present invention, as well as the methods of operation and functions of the related elements of the structure, and the combination of parts and economics of manufacture, will become more apparent upon consideration of the following detailed description and the appended claims with reference to the accompanying drawings all of which form a part of this specification, wherein like reference numerals designated corresponding parts in the various figures.

DETAILED DESCRIPTION OF THE PRESENTLY PREFERRED EXEMPLARY EMBODIMENT

Figure 1:
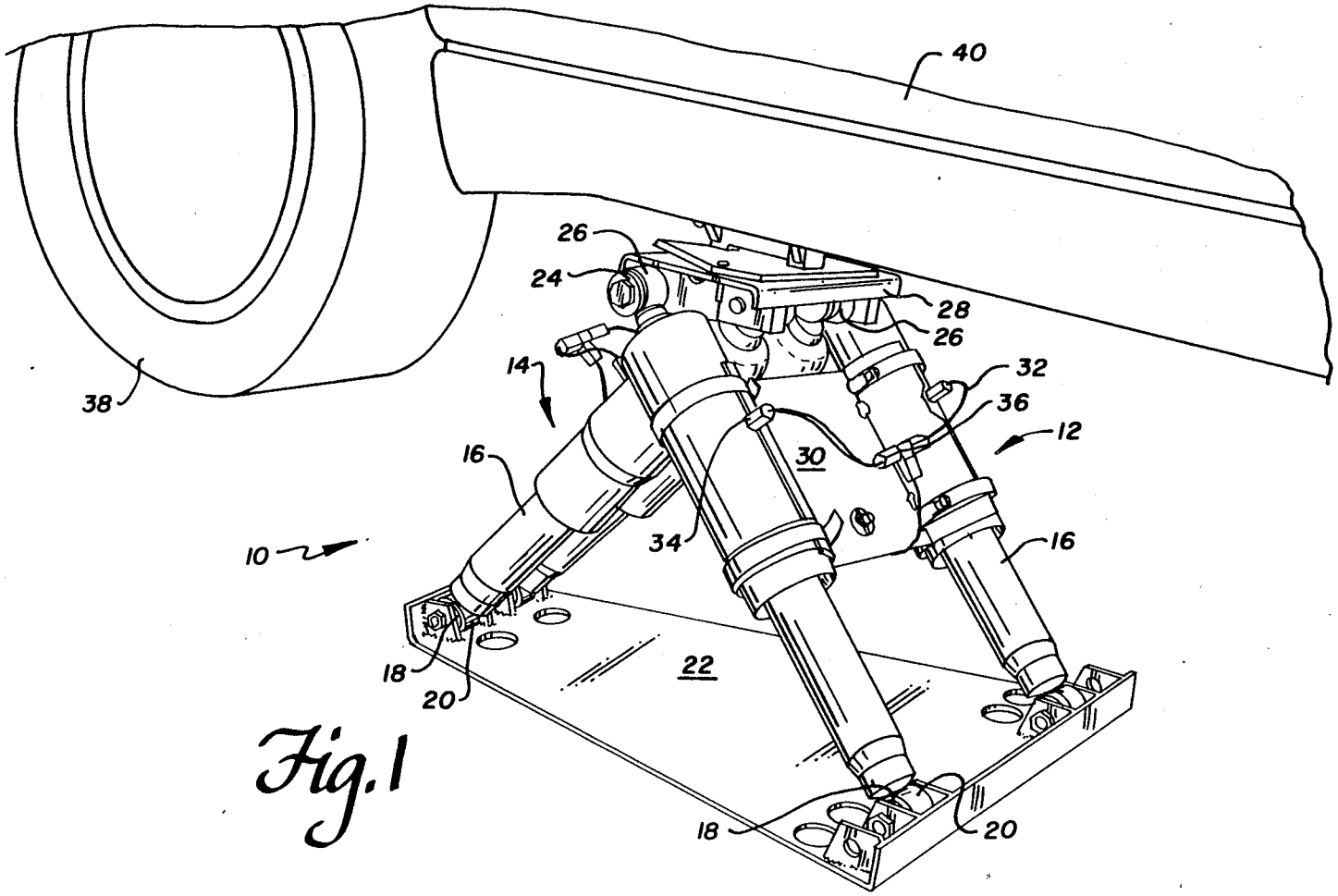
FIG. 1 is a perspective view of the automotive jack provided in accordance with the present invention in an extended position below a vehicle, adjacent a vehicle wheel.
Figure 2:
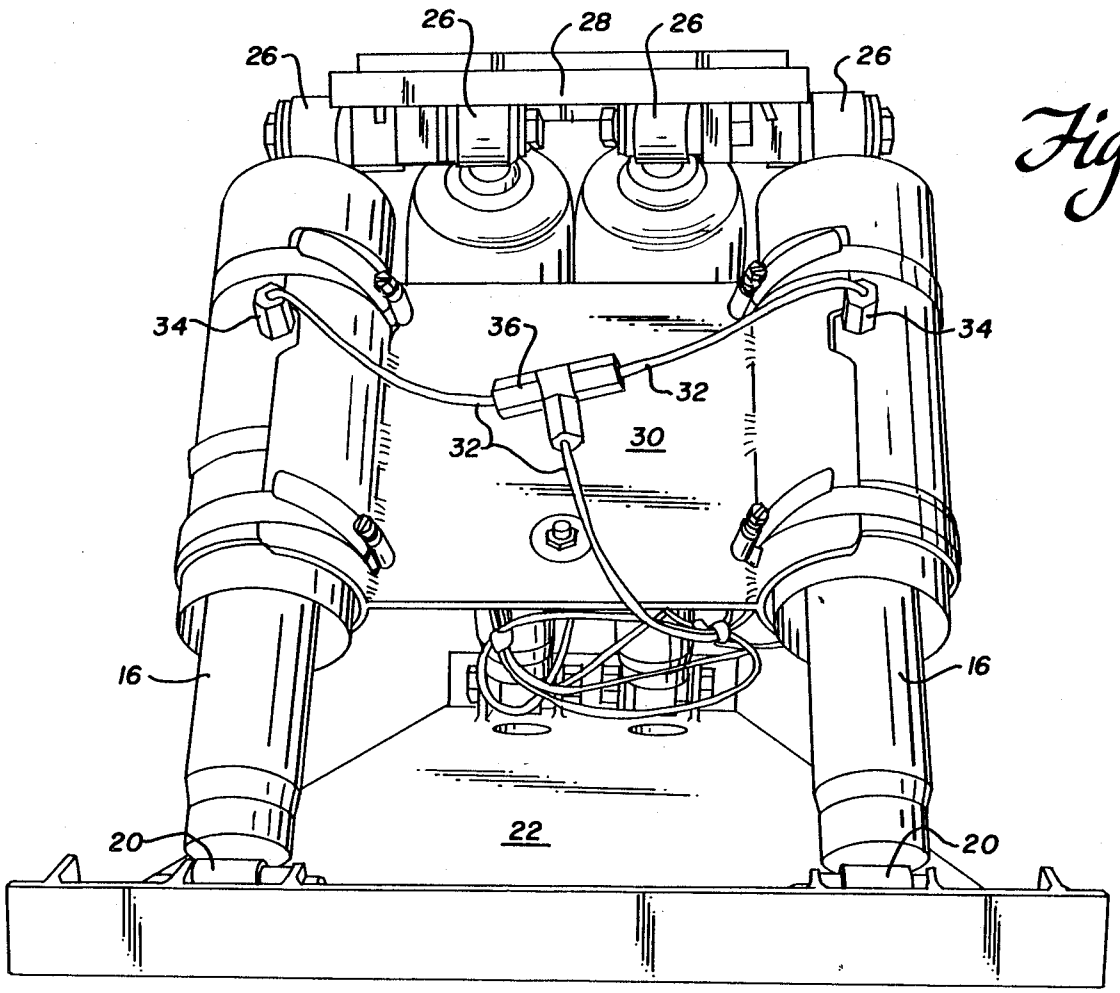
FIG. 2 is an end view of the automotive jack showing the spaced apart pair of cylinders provided in accordance with the present invention.
Figure 3:
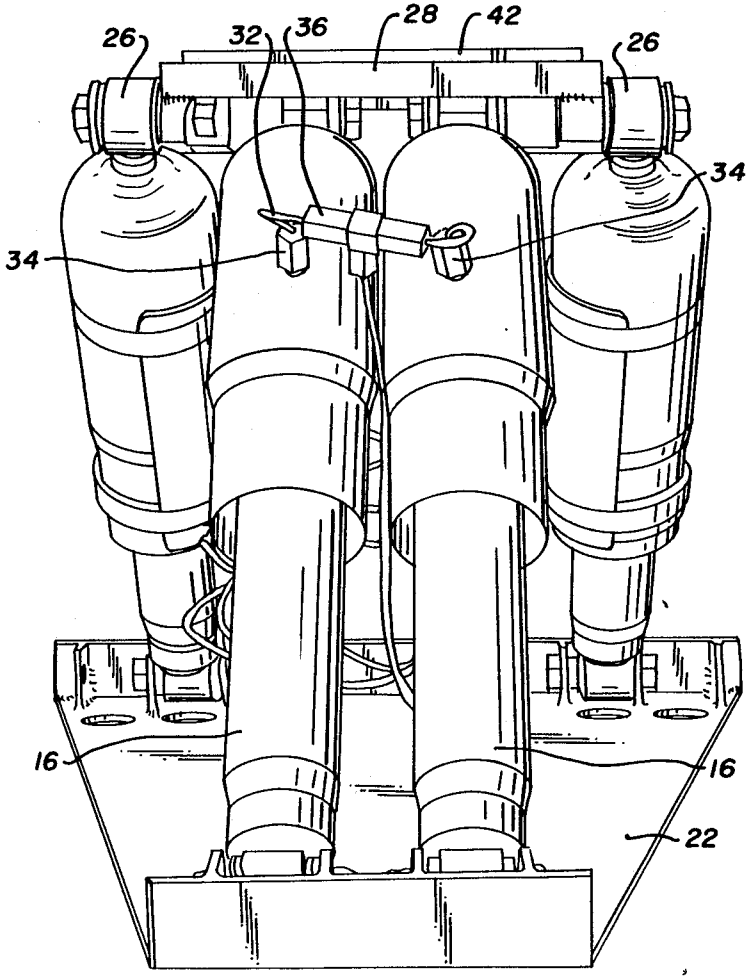
FIG. 3 is an end view of the automotive jack provided in accordance with the present invention, showing the closely spaced air cylinders.

Referring in particular to FIGS. 1–3, the automotive jack 10 provided in accordance with the present invention employs two pairs 12, 14 of cylinders 16 which may be air actuated (pneumatic) or hydraulic cylinders or a combination thereof. Each of the cylinders 16 is pivotally mounted with an elastomeric bushing 18 and an eye ring 20 to the base 22 of the jack 10. Similarly, the upper ends of the cylinders 16 are mounted with an elastomeric bushing 24 and an eye ring 26 to a top, lifting assembly 28.

One of the pairs, 12, of air or hydraulic fluid actuated cylinders 16 provided in accordance with the invention is substantially widely spaced apart so as to straddle the pair 14 of more closely mounted cylinders. Because two of the cylinders are spaced apart and two disposed closely together, the base 22 of the jack can be triangular in shape so as to minimize the storage space required for the jack assembly. It is to be understood, however, that a rectangular or other shaped base could be employed if desired.

As can best be seen in FIG. 2, a brace plate 30 is mounted between and connects the spaced apart pair 12 cylinders 16. As can be seen, plate 30 is coupled to the movable portion of cylinders 16. Plate 30 triangulates and stabilizes the two cylinders 16 but does not interfere with actuation of the assembly. In this regard, it is to be understood that while a plate 30 is shown for performing this function, other bracing or supporting structures could be employed. The brace plate 30 reduces somewhat the degree of freedom of movement of the cylinders of the jack but permits accommodation to the changing geometry of the vehicle, verses the horizontal, as it is being lifted.

As can be seen in the illustrated embodiment, the cylinders 16 are preferably fluidly connected by flow lines 32 which are coupled to cylinders 16 with suitable connectors 34 and interconnected with, for example, T-connectors 36. While in the illustrated embodiment flow lines 32 and T-connectors 36 are shown for fluidly connecting the cylinders, it is to be understood that any suitable means for operatively interconnecting the cylinders could be provided.

Figure 5:
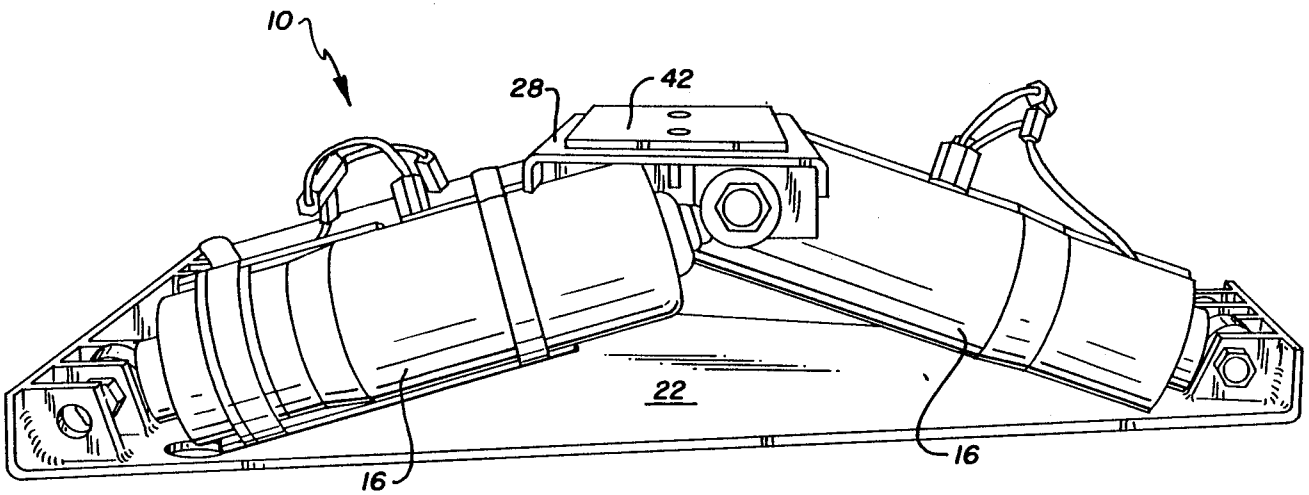
FIG. 5 is a side elevational view of the jack provided in accordance with the present invention in its unextended or storage configuration.

Referring to FIG. 5, the automotive jack assembly 10 provided in accordance with the invention is shown in its unactuated storage configuration. In this configuration, the jack 10 is placed below a desired portion of the vehicle, such as adjacent and in front of a rear wheel 38 of the vehicle 40 (FIG. 1). The upper surface of the top plate of the assembly 28 is preferably provided with an elastomeric pad 42 or the like for engaging the under surface of the vehicle 40. Once the jack 10 is in position below the vehicle, the cylinders 16 which are fluidly interconnected are actuated so that each of the cylinders 16 extends thereby moving the lifting assembly 28 upwardly into engagement with the vehicle 40.

Figure 4:
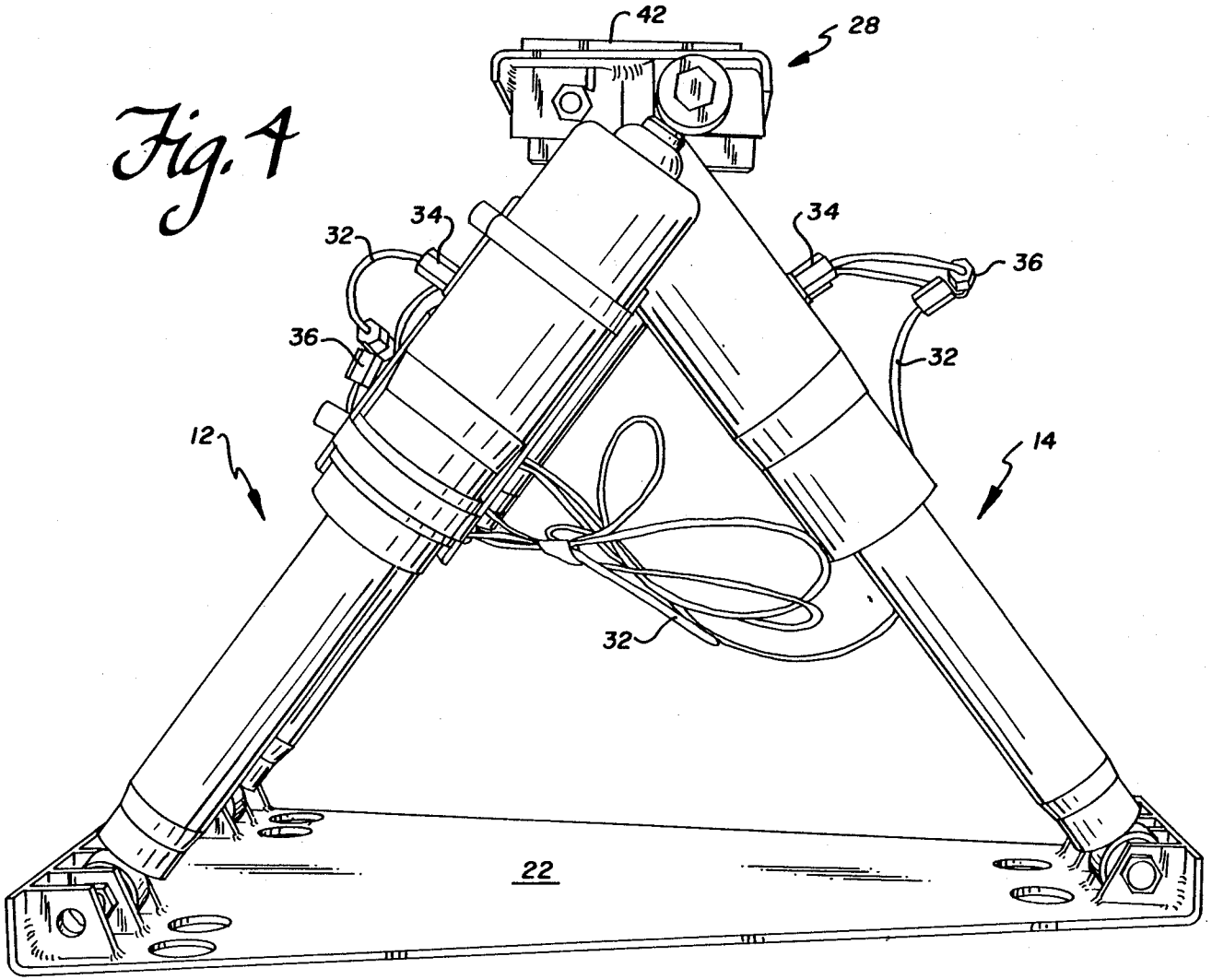
FIG. 4 is a side elevational view of the jack provided in accordance with the present invention in is extended position.

As is apparent from FIGS. 4 and 5, in all positions the jack assumes a generally triangular configuration when viewed from the side. Only the length of the two cylinder "legs" defined by each pair 12, 14 of cylinders 16 changes defining triangles comprised of various heights and angles. This in combination with a shared source of pressurized air or hydraulic fluid (not shown in particular) permit the jack to exert a substantially uniform force over a range of cylinder stroke positions or angles. Thus, the shared source of air pressure or hydraulic fluid and triangular configuration of the jack 10 enable the cylinders 16 to accommodate changes in angle of the vehicle 40 as it is being jacked to ensure a balanced lifting of the vehicle 40 and stable support of the same once the jacking operation is terminated.

Further, as the elastomeric pad 42 of the lifting assembly engages the vehicle 40 and the vehicle 40 is lifted, the lifting pad assembly 28 can change in angle and position to accommodate changes in angle of the vehicle as it is being jacked. This permits both the base 22 and the lifting assembly is to conform and adapt to the less than ideal surfaces which may be present below the vehicle 40 and/or on the under surface of the vehicle 40.

In contrast to the jack systems heretofore provided, then, the automotive jack of the invention provides inherent stability, relative insensitivity to the hardness and flatness of the jacking surface, sensitivity to the construction of modern cars in that it does not require disposition below a vehicle frame or other heavy structure, and an ability to accommodate forward or backward movement of a vehicle being jacked. Each of the foregoing clearly provide significant advantages over the conventional floor jacks.

In addition to the relative safety benefits described above, orifice check valves (not shown in particular) can be installed in each cylinder. Should a pressure line rupture, for example, the resulting pressure differential would creat sufficient velocity and flow to set the check valves, the valves each possessing a sufficiently small by-pass orifice that pressure is reduced so slowly that one is allowed reasonable time to move to safety if necessary. Again, since all cylinders are plumbed in series, remaining forces generated are uniformly distributed as the jack descends slowly.

Further, the unique geometry of the jack has many diverse applications outside of the automotive field. For example, it could be employed rather than current jacking mechanism for hospital patient beds and other structures requiring selective lifting in a confined space. Indeed, the geometry and degrees of freedom of the present invention have potential utility in a range of lifting applications. Therefore, it is to be understood that air and/or hydraulic cylinders may be used for actuation. Further, the lifting pad can be varied in length and/or width to lift relatively distant jacking points, depending on the particular environment in which the jack is employed. For example, lengthening the lift pad will reduce unit pressure and will increase stability. In the alternative, by increasing pad width only for example, by increased leverage to produce degrees of freedom can be obtained.

While the invention has been described in connection with what is presently considered to be the most practical and prefered embodiment, it is to be understood that the invention is not limited to the disclosed embodiment, but, on the contrary, is intended to cover various modifications and equivalent arrangements included within the spirit and scope of the appended claims.

What is claimed is:

1. A portable jacking mechanism comprising:

a base plate member;

a top, lift plate element;

a first pair of hydraulic or pneumatic cylinder means mounted in side by side parallel relation, said cylinder means being spaced apart a predetermined distance, a bottom most end of each of said cylinder means being pivotally coupled to said bottom plate element, and an upper most end of each of said cylinder means being pivotally mounted to said top, lift plate;

means mounted to a movable portion of each of said cylinder means of said first pair and extending therebetween so as to maintain said cylinder means in fixed spaced apart relation; and a second pair of hydraulic or pneumatic cylinder means mounted in side-by-side parallel reaction, said cylinder means of said second pair being mounted immediately adjacent to one another, a bottom most end of each of said cylinder means of said second pair being pivotally coupled to said base member at a point spaced from said mounting of said first pair of cylinder means, and an upper most end of said cylinder means of said second pair being pivotally mounted to said top, lift plate so that said cylinder means of said first pair straddle said cylinder means of said second pair, each of said cylinder means being mounted to said top, lift plate and said bottom plate so that each of said pairs of cylinder means defines a leg of a triangle and said base member defines the base of said triangle, said cylinder means being fluidly coupled together so as to be actuated by a common source of hydraulic fluid or compressed air.

2. A jacking mechanism as in claim 1, wherein said means mounted to and between said first pair of cylinder means comprises a plate member.

3. A jacking mechanism as in claim 1, wherein a plane defined through said first pair of cylinder means passes through a plane defined by said second pair of cylinder means vertically below said top, lifting pad so that said cylinder means of said first pair cross said cylinder means of said second pair and are coupled to said top, lifting pad at a point spaced from said second pair.

4. A jacking mechanism as in claim 1, wherein said base member has a substantially triangular shape.

5. A jacking mechanism as in claim 1, wherein an uppermost surface of said top, lifting pad has an elastomeric material deposed thereon.

6. A jacking mechanism as in claim 1, wherein said cylinder means of said first pair and said cylinder means of said second pair are fluidly coupled by a plurality of flow lines fluidly coupled to each of said cylinder means.

* * * * *